United States Patent [19]

Manabe et al.

[11] Patent Number: 4,946,349

[45] Date of Patent: Aug. 7, 1990

[54] WATER RING VACUUM PUMP

[75] Inventors: Kyoichi Manabe, Tokyo; Hideo Yamashiro, Kobe, both of Japan

[73] Assignees: National Space Development Agency of Japan, Tokyo; Kawasaki Jukogyo Kabushiki Kaisha, Kobe, both of Japan

[21] Appl. No.: 382,558

[22] Filed: Jul. 19, 1989

[51] Int. Cl.[5] ..... F04C 19/00; F04B 23/08; F04B 23/14

[52] U.S. Cl. ..... 417/68; 417/69; 417/199.2; 417/201; 417/205; 415/89; 415/169.1

[58] Field of Search ..... 417/68, 69, 199.2, 201, 417/205; 415/89, 169.1, 169.2; 55/199, 201, 203, 408

[56] References Cited

U.S. PATENT DOCUMENTS 2,940,657 6/1960 Adams ..... 417/65
4,257,749 3/1981 Ramm ..... 417/68
4,283,005 8/1981 Erickson ..... 415/89

*Primary Examiner*—Leonard E. Smith
*Assistant Examiner*—John A. Savio, III
*Attorney, Agent, or Firm*—Marshall, O'Toole, Gerstein, Murray & Bicknell

[57] ABSTRACT

A pumping system comprising a liquid ring vacuum pump including a casing and a rotatable runner. A Pitot pump including a casing, a Pitot tube, an impeller and a drum, the impeller and the drum being rotatably mounted in the casing, and the Pitot tube being mounted within the casing adjacent the outer periphery thereof. A gas passage leads into the vacuum pump, from the vacuum pump into the Pitot pump, and out of said Pitot pump, and a liquid passage leads from the Pitot tube to the vacuum pump. The system further includes a cooler connected to the liquid passage for cooling liquid therein, and a drive motor coupled to rotate the runner, the impeller and the drum.

6 Claims, 1 Drawing Sheet

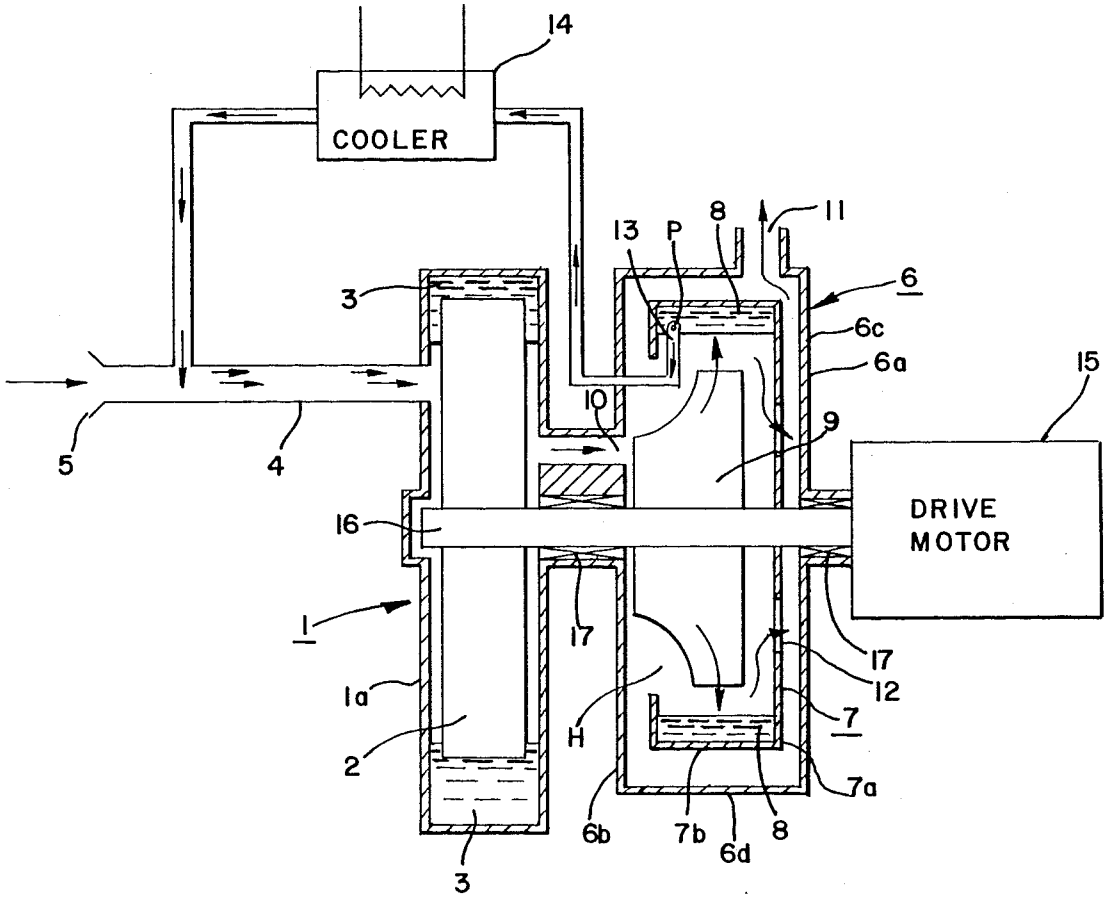
DRIVE MOTOR
COOLER
15
6
6c
6a
11
9
17
12
7
7a
8
6d
7b
6b
H
8
P
13
10
17
14
3
3
16
1a
2
1
4
5

WATER RING VACUUM PUMP

FIELD AND BACKGROUND OF THE INVENTION

This invention relates to a water ring vacuum-pumping system, and in particular to such a system effective for use under zero gravity conditions such as those encountered in outer space.

A conventional pumping system of this type includes a water ring vacuum pump, a gas/liquid separation tank for separating, by means of gravity, the gas and liquid discharged from the pump, and a return pump for returning the separated liquid to the vacuum pump after it has been cooled.

The foregoing conventional system is relatively complex and large in size, and it is therefore unsuitable for use in a space station where there are strict limits as to installation space and weight. In addition, under zero gravity conditions, the conventional gas/liquid separation tank which operates by gravity would have difficulty performing adequately.

SUMMARY OF THE INVENTION

It is a general object of the invention to provide a relatively small water ring vacuum pumping system which is not complex and is suitable for use under zero gravity conditions.

A system according to this invention comprises a water ring vacuum pump and a Pitot pump, which are preferably on a single drive shaft. An outlet port of the vacuum pump is connected to an inlet port of the Pitot pump. The Pitot pump includes a rotary drum mounted on the drive shaft, a gas/liquid inlet opening, a gas outlet port, and the drum forms a peripheral liquid sump. The drum surrounds a centrifugal impeller mounted on the shaft, and a Pitot tube has an opening in the drum sump and returns liquid from the sump to the vacuum pump. A cooler is preferably provided to cool the liquid flowing to the vacuum pump.

In operation, a fluid mixture of gas and separated liquid is sucked into the vacuum pump through its inlet port. The gas is compressed by the vacuum pump and discharged as a fluid containing some of the sealing liquid, and it is flung outwardly by the rotating impeller in the Pitot pump to undergo centrifugal liquid separation. Thus, gas and liquid are separated from each other, and the gas is discharged through an outlet port of the Pitot pump, while the separated liquid is retained in the sump by centrifugal force of the drum. This separated water is returned to the inlet port of the vacuum pump via the Pitot tube.

BRIEF DESCRIPTION OF THE DRAWING

A preferred embodiment of the invention is shown in the accompanying drawing, which is a sectional view of a pumping system according to the invention during operation of the system.

DETAILED DESCRIPTION OF THE DRAWING

The illustrated system includes a conventional water ring vacuum pump 1 having a rotor or runner 2 mounted in a drum-like casing 1*a*. The runner 2 is mounted on a rotatable drive shaft 16 which is positioned eccentrically from the axis of the pump casing 1*a*. The side of the pump casing 1*a* is connected with an inlet tube 4 which has an intake opening 5 at its other end. The casing 1*a* contains a suitable amount of sealing liquid 3, which may be water or other liquids, and is sufficient to cover the outer periphery of the runner 2 during operation (as shown in the drawing).

The runner 2 includes a plurality of generally radially extending blades or vanes which extend into the liquid 3. When the runner 2 rotates, the liquid is moved with it and forms a circular ring or layer concentric to the casing 1*a* due to centrifugal force. This forms sealed chambers enclosed between adjacent runner blades and the liquid layer. The chambers change in volume as the runner 2 rotates because of the eccentric mounting of the runner 2, continuously producing a sequence of suction, compression and discharge. In the process of this operation, the sucked gas from the inlet 4 is compressed and discharged along with some of the sealing liquid 3 through an outlet port 10 formed in the wall of the casing 1*a*. As previously mentioned, the foregoing described construction and operation is conventional.

The Pitot pump 6 includes a cylindrical drum-like casing 6*a* having two radial side walls 6*b* and 6*c* and an annular outer wall 6*d*. The outlet port 10 of vacuum pump 1 is connected to an inlet port formed in one of the side walls of the Pitot pump casing 6*a*.

The casing 6*a* houses a rotary drum 7 mounted on the drive shaft 16. The drive shaft 16 is rotated by an electric motor 15 and it extends into the two pump casings 1*a* and 6*a*. Bearings and seals 17 connect the shaft 16 with the two casings. The drum 7 is formed with a fairly large inlet opening H on the inlet side of Pitot pump 6, and outlet openings 12 for the separated gas in the opposing radial side wall 7*a*. The drum 7 is also formed with a circumferential or annular liquid sump 8 for retaining the separated water on the inside of the peripheral wall 7*b*.

The drum 7 surrounds an impeller 9 which is also mounted on the shaft 16 so as to separate the liquid from the gas by centrifugally flinging out the water The impeller 9 has the shape of a centrifugal pump impeller and it throws the gas-liquid mixture radially outwardly into the sump 8.

In the drum sump 8 is positioned the opening P at one end of a Pitot tube 13 through which the separated water is returned. The tube 13 is connected via a liquid cooler 14 to the intake tube 4 of the vacuum pump 1. The outermost end portion of the Pitot tube 13 extends in the circumferential direction and the opening P is in the end of the tube and it faces the direction of the oncoming liquid in the sump 8.

When the runner 2, the drum 7 and the impeller 9 are rotated, gas is sucked from outside through the vacuum pump intake 5 and into the vacuum pump 1 together with the separated liquid joining it along the way. The separated liquid is returned as the sealing liquid 3, while the gas is compressed and discharged through the outlet 10 as mixed fluid that contains some of the sealing liquid 3.

This fluid enters the Pitot pump 6 and is flung radially out by the centrifugal force of the impeller 9. In this way, the liquid and the gas are separated, and the gas is discharged through the drum outlet openings 12 and the outlet port 11 in the Pitot pump casing 6*a*.

The separated liquid is collected in the drum sump 8 and retained in a state as if fixed to the peripheral wall 7*b* by centrifugal force. In this way, the separated water is not dispersed even under zero gravity conditions, and it can be circulated to and collected in the vacuum pump 1 via the Pitot tube 13.

In other words, the separated liquid is pushed into the opening P of tube 13, is cooled by the cooler 14, then is returned to the suction tube 4, and is sucked into the vacuum pump 1 to act again as the sealing liquid 3.

Because the performance of the vacuum pump 1 is largely affected by the vaporization pressure of the sealing liquid 3, it is advantageous to keep this liquid cool. It is therefore advantageous to cool the separated liquid in the cooler 14 before returning it to the vacuum pump 1 as explained above.

Since the separated liquid 3 is recycled for reuse, it is not necessary to replenish the sealing liquid from an outside source, thus simplifying the system. The Pitot pump, which has a centrifugal water-separating function, is combined with the conventional water ring vacuum pump, and therefore it is possible to attain a simple and compact pumping system featuring water separation and water feed functions. Further, because the water is separated centrifugally, gas/liquid separation can be achieved even under zero gravity.

What is claimed is:

1. A pumping system comprising:

a casing, a drive shaft journalled with respect to said casing and adapted to be rotated, a liquid ring vacuum pump coupled to be driven by said shaft and having inlet and outlet ports, a Pitot pump having a gas/liquid inlet port connected to said outlet port of said vacuum pump and a gas outlet port, said Pitot pump including a rotary drum coupled to be rotated by said shaft, said drum having a peripheral sump, an inlet opening communicating with said gas/liquid inlet port of the Pitot pump, and an outlet opening communicating with said gas outlet port of the Pitot pump, a centrifugal impeller coupled to be rotated by said shaft, said drum surrounding said impeller, and a Pitot tube having an opening located in said sump of the drum, said Pitot tube further being connected to said inlet port of said vacuum pump.

2. A pumping system as set forth in claim 1, and further including cooling means connected between said Pitot tube and said inlet port of said vacuum pump for cooling liquid.

3. A pumping system comprising:

(a) a liquid ring vacuum pump including a casing and a rotatable runner;

(b) a Pitot pump including a casing, a Pitot tube, an impeller and a drum, said impeller and said drum being rotatably mounted in said casing and said impeller being mounted and operating inside said drum, and said Pitot tube being mounted within said casing adjacent the outer periphery thereof;

(c) a gas passage leading into said vacuum pump, from said vacuum pump into said Pitot pump, and out of said Pitot pump; and (d) a liquid passage leading from said Pitot tube to said vacuum pump.

4. A pumping system as set forth in claim 3, and further including a cooler connected to said liquid passage for cooling liquid therein.

5. A pumping system as set forth in claim 3, and further including a drive motor coupled to rotate said runner, said impeller and said drum.

6. A pumping system as set forth in claim 3, wherein said Pitot tube includes an opening which faces in the direction of oncoming motion of said drum.

* * * * *